US007201122B2

(12) United States Patent
Schmidt

(10) Patent No.: US 7,201,122 B2
(45) Date of Patent: Apr. 10, 2007

(54) DEVICE FOR CONTROLLING VALVE KINEMATICS

(76) Inventor: Philippe Schmidt, Chemin du Centenaire 8, CH-1008 Prilly (CH)

( * ) Notice: Subject to any disclaimer, the term of this patent is extended or adjusted under 35 U.S.C. 154(b) by 119 days.

(21) Appl. No.: 10/477,089

(22) PCT Filed: May 7, 2002

(86) PCT No.: PCT/CH02/00244

§ 371 (c)(1),
(2), (4) Date: Apr. 7, 2004

(87) PCT Pub. No.: WO02/090728

PCT Pub. Date: Nov. 14, 2002

(65) Prior Publication Data

US 2004/0163615 A1 Aug. 26, 2004

(30) Foreign Application Priority Data

May 10, 2001 (CH) ..... 847/01

(51) Int. Cl.
*F01L 1/34* (2006.01)

(52) U.S. Cl. ..... 123/90.16; 123/90.39; 123/90.44

(58) Field of Classification Search ..... 123/90.16, 123/90.27, 90.31, 90.39, 90.41, 90.44, 90.6, 123/90.65, 90.66, 90.67, 90.2; 74/559, 562, 74/567, 569

See application file for complete search history.

(56) References Cited

U.S. PATENT DOCUMENTS 1,633,882 A * 6/1927 Ballot ..... 123/90.25
2,641,236 A * 6/1953 Mansfield ..... 123/90.24
3,313,280 A 4/1967 Arutunoff et al.
4,420,141 A * 12/1983 Goloff ..... 251/337
4,724,822 A * 2/1988 Bonvallet ..... 123/90.16

FOREIGN PATENT DOCUMENTS

DE 100 61 711 8/2001
GB 359 715 10/1931
WO WO 9637688 A1 * 11/1996

OTHER PUBLICATIONS

Patent Abstracts of JAPAN, vol. 013, No. 380 (M-863). Aug. 23, 1989 & JP 01 134009 A (Yoshiari Takagi). May 26, 1989 Abstract.

* cited by examiner

*Primary Examiner*—Ching Chang
(74) *Attorney, Agent, or Firm*—Ostrolenk, Faber, Gerb & Soffen, LLP

(57) ABSTRACT

A device for controlling the variation of the opening and closing times and durations of a valve (8) comprises an elastic means (18) acting upon an assembly consisting of a lever device (1) and a valve stem (11) not in the closing direction but in the opening direction of the valve (8). The assembly consisting of the lever device (1) and of the opening cam (5) and the closing cam (6) fulfils a dual function, one for opening the valve (8), the other for moving it back for its closure. The control device, which comprises a device for offsetting the angular position of the cam position relative to the crankshaft, allows to control the opening and closing duration of the valve (8) over a very wide range extending, for opening, from 210° to 350° of crankshaft rotation approximately, by varying the valve opening and closing times independently of each other. It is applicable to a wide range of engines.

13 Claims, 8 Drawing Sheets

DEVICE FOR CONTROLLING VALVE KINEMATICS

FIELD OF THE INVENTION

The present invention relates to a device for controlling the kinematics of at least one valve, the device comprising at least one opening cam and one closing cam, and at least one lever device cooperating with the valve and subject, together with the latter, to the action of an elastic member.

PRIOR ART

The variable control of valves, i.e. variable timing, is a complex problem that has often been approached. According to several recent studies, the majority of the systems suggested up to now comprise a limited variability of opening durations or do not offer a progressive variation of the opening durations. Certain electro-hydraulic systems offer a higher flexibility of the opening duration, but they suffer from the disadvantage of being very complex and are subject to technical problems that are difficult to solve, such as delays and the compressibility in the hydraulic circuits as well as the space consumption of their components.

SUMMARY OF THE INVENTION

Based on this state of the art, it is an object of the present invention to propose a control device as cited above which allows to control the opening and closing duration of the valve over a wide range (comprised, for the opening, between 210° and 350° of camshaft rotation approximately), while varying the opening and closing times of the valve(s) independently of each other. The implementation of this device may be provided for a wide range of engines. This object is attained by a control device wherein the elastic member constitutes a detent means acting upon the assembly composed of the lever device and of the stem of the valve in the opening direction of the valve, and in that the assembly comprising the rocker arm and the cam allows the opening of the valve and furthermore generates the return movement of said valve onto its seat for its closure.

BRIEF DESCRIPTION OF THE DRAWINGS

Embodiments of the invention will be described by way of non-limiting examples hereinafter with reference to the enclosed drawings where.

DETAILED DESCRIPTION OF PREFERRED EMBODIMENTS

Figure 1:
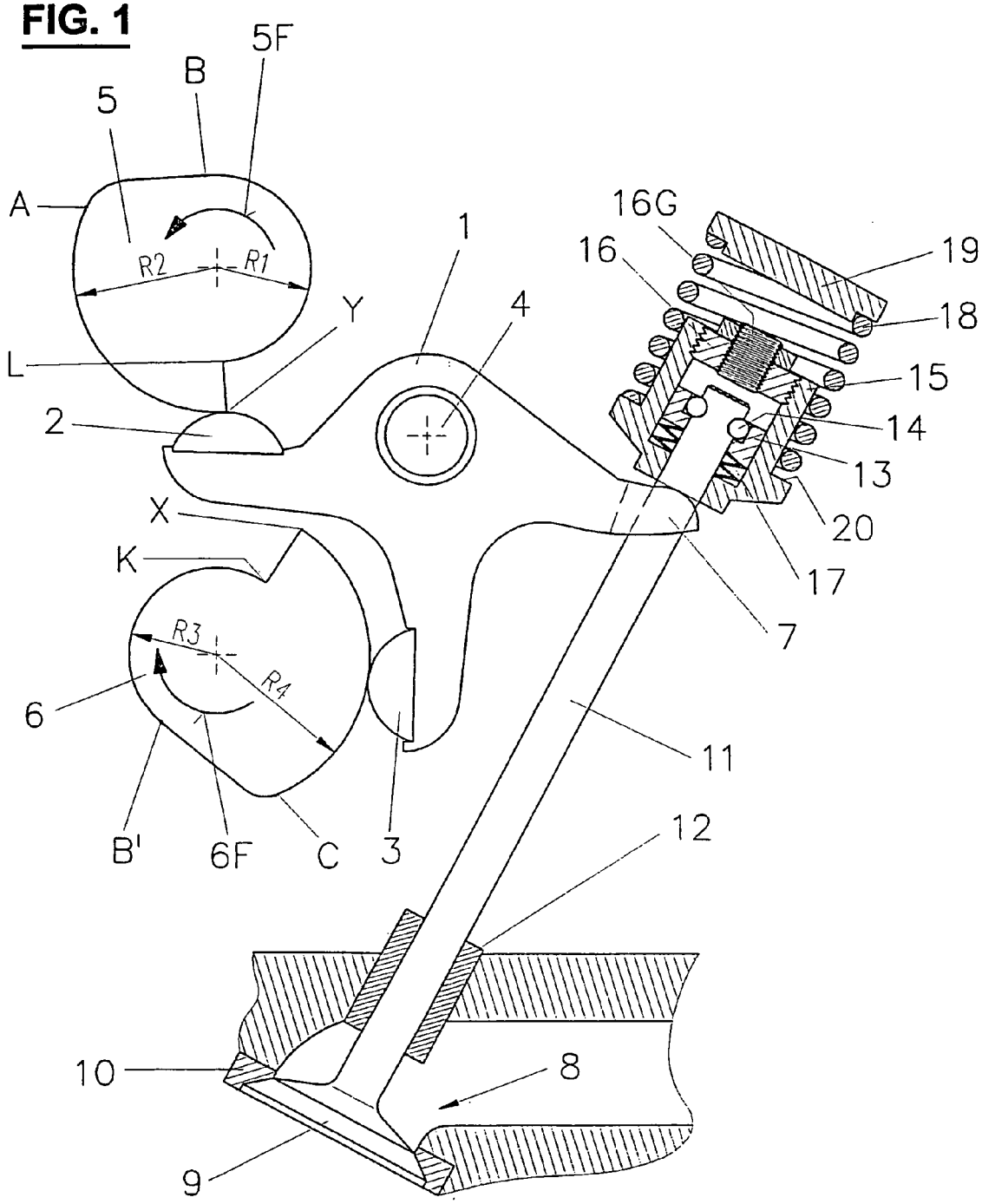
FIG. 1 schematically shows a first embodiment of a device of the invention with the valve in the closed position.
Figure 2:
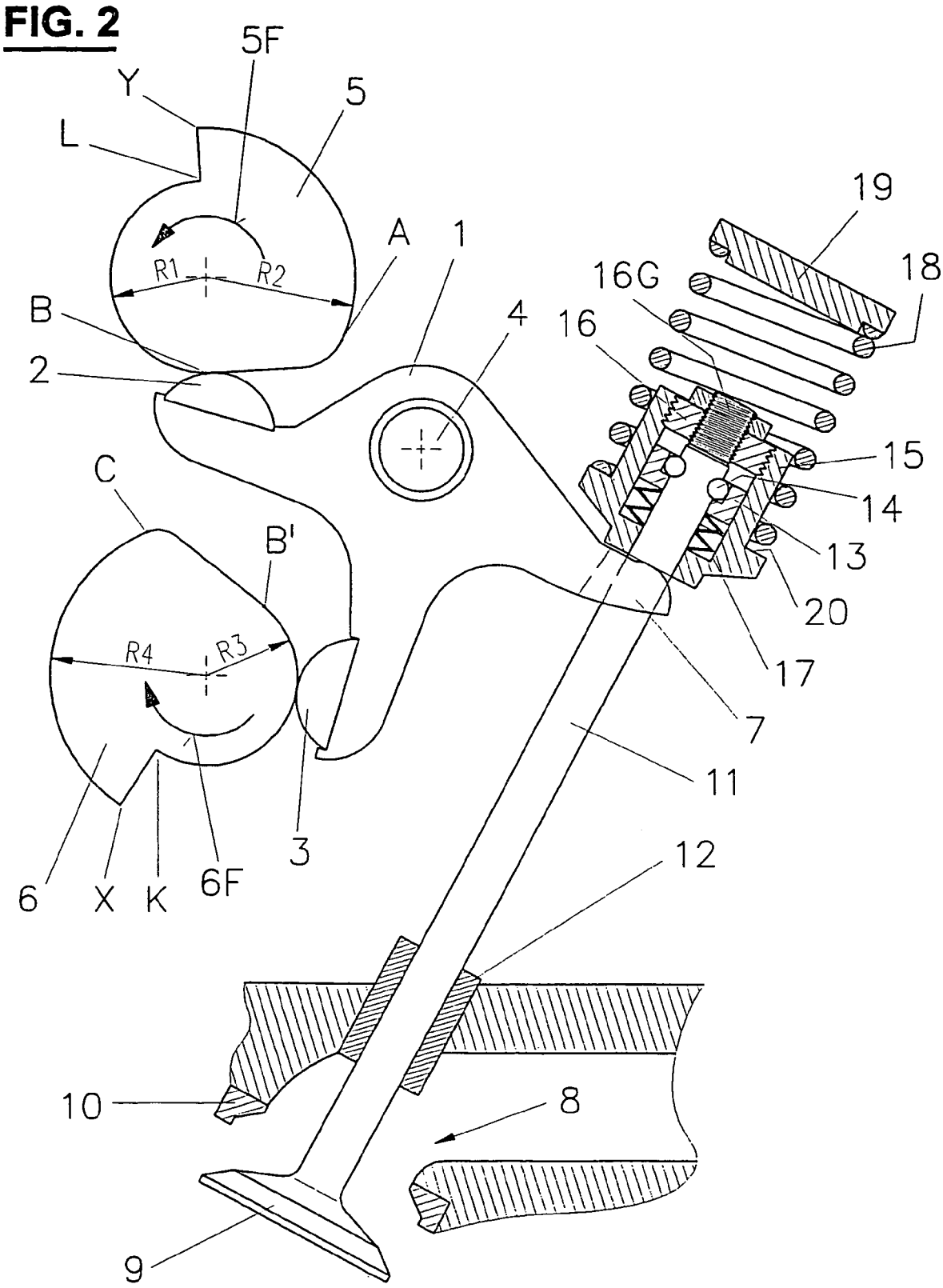
FIG. 2 shows the device of FIG. 1 with the valve in the open position.

FIGS. 1 and 2 refer to an engine with a cylinder head comprising two valves and two common camshafts for intake and exhaust. A rocker arm 1 with its two sliders 2, 3 pivoting around its shaft 4 is controlled by two cams, namely an opening cam 5 and a closing cam 6, the two cams rotating in opposite directions, as indicated by arrows 5F, 6F. Rocker arm 1 further comprises a fork 7 for controlling valve 8, shown in the closed position in FIG. 1 and in the open position in FIG. 2.

Opening cam 5 includes three distinct geometric portions: a first concentric portion Y-A (corresponding to the retention of valve 8 against its seat 10 and to the takeover of rocker arm 1 during the closed valve phase (large radius R2 of the cam)), a second eccentric portion A-B (causing the opening movement of the valve), and a third concentric portion B-L (small radius R1 of the cam).

In analogy, closing cam 6 comprises a first concentric portion K-B' (zone of takeover of rocker arm 1 during the open phase of valve 8 (small radius R3 of the cam)), a second eccentric portion B'-C (causing the closing movement of the valve), and a third concentric portion C-X, corresponding to the retention of valve 8 against its seat 10 (large radius R4 of the cam).

Valve 8 is provided at its lower end with a tulip 9 adapted to press against a seat 10, the tulip being followed by a stem 11 that is guided by a valve stem guide 12 and fastened by means of a locking device comprising a valve spring seat 13 cooperating with a circular clip 14 and sliding in a tubular valve retainer 15 whose upper part is fitted with a locking ring 16 allowing the closure of a non-referenced valve retainer chamber. Locking ring 16 is provided with a threaded bore for receiving an adjusting pin 16G for adjusting the initial tension of a spring 17 adapted to act upon stem 11 of the valve (through elements 13, 14).

This damping spring 17 is accommodated in the space formed between the bottom of valve retainer 15 and valve spring seat 13. The function of this damping spring is easily understood when comparing FIGS. 1 and 2 and reading the discussion of the operation of the device (see below, point 10 of the present disclosure).

Inversely to valve controls of the prior art, an elastic member acting upon valve 8 and rocker arm 1 is formed of a valve relieving spring 18. The latter tends to open the valve and allows the rocker arm, which retains the valve through valve retainer 15, damping spring 17 and locking device 13, 14, to follow the profile of the cams. Spring 18 is maintained by an upper spring seat 19, on one hand, and on the other hand, by a circular shoulder 20 formed around valve retainer 15.

Figure 3:
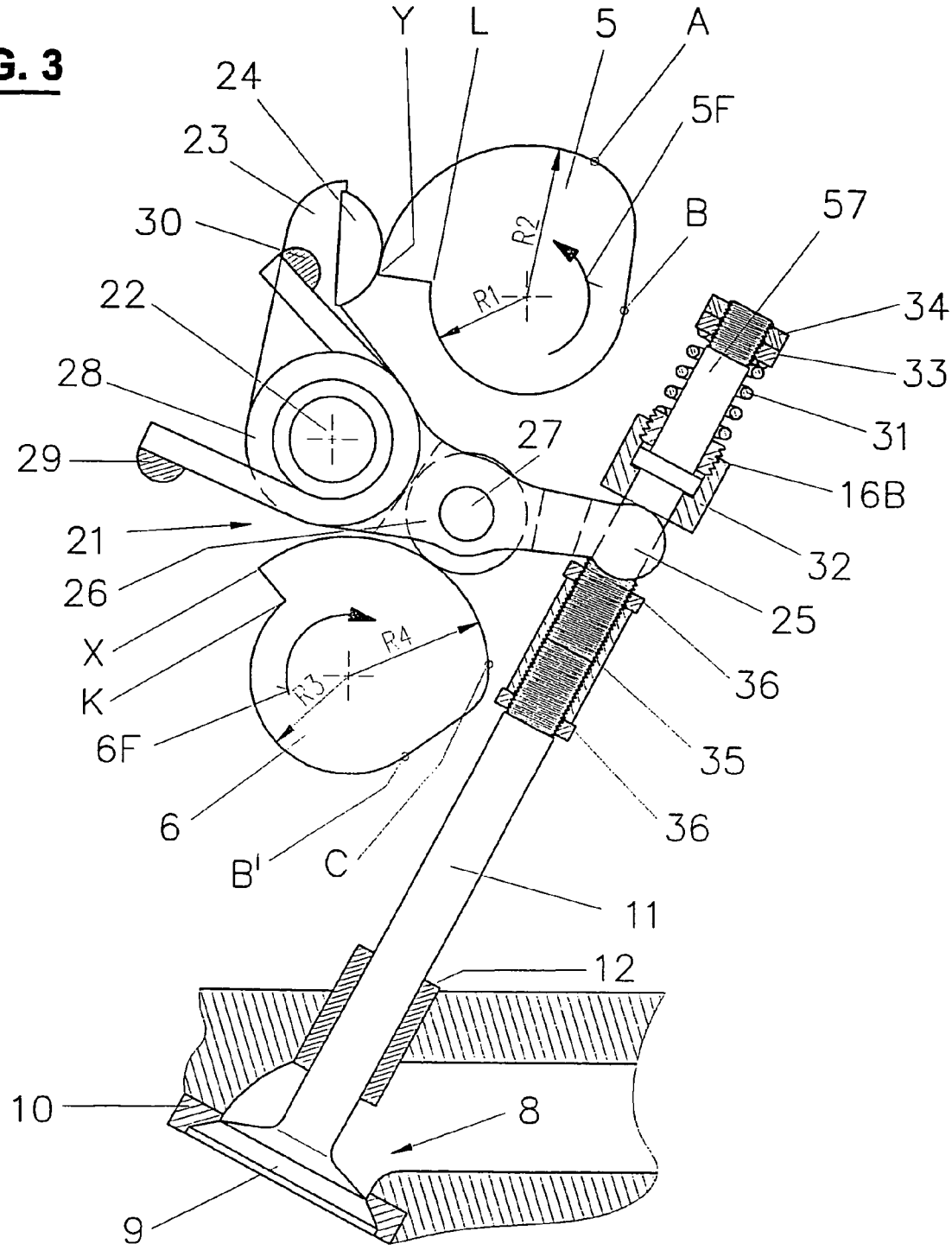
FIG. 3 shows a second embodiment of a device of the invention with the valve in the closed position.
Figure 4:
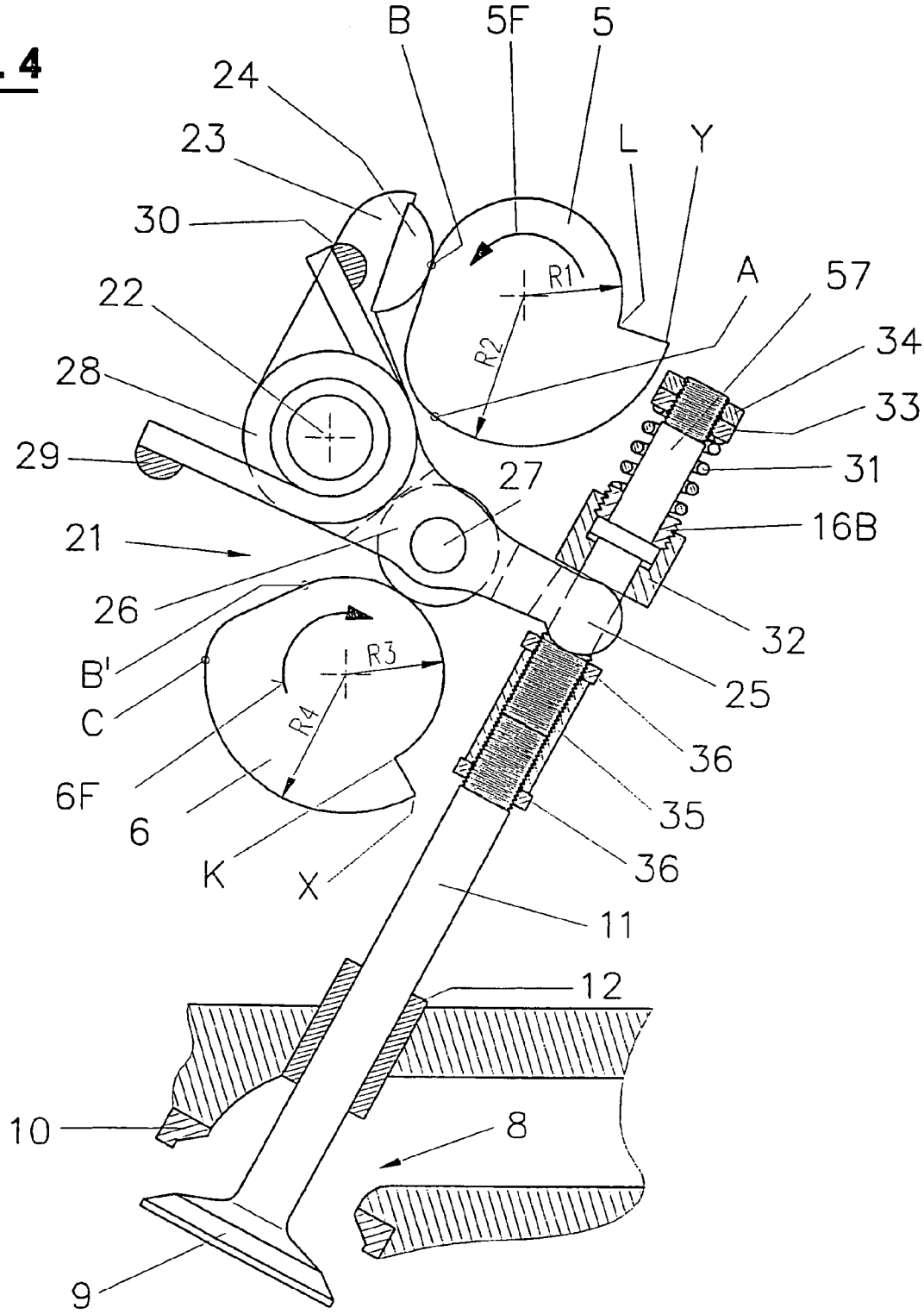
FIG. 4 shows the device of FIG. 3 with the valve in the open position.

FIGS. 3 and 4 show a variable timing system for an engine with a four-valve cylinder head with valve 8 in the closed and in the open position, respectively. One rocker arm 21 is common to two valves and pivots around a shaft 22. The rocker arm comprises an arm 23 carrying a contact member 24 (e.g. a roller bearing or, as in the illustrated embodiment, a slider 24) and a fork 25 for actuating valve 8. Opening cam 5 acts upon slider 24 of the arm of the rocker arm, whereas closing cam 6 acts upon a roller bearing 26 turning on an axle 27 mounted on the arm of the rocker arm provided with fork 25.

In this embodiment for four valves per cylinder, the rocker arm is not actuated by a spring that is positioned in the axis of the valve stem but by a detent spring 28 one shank of which rests on a stop 29 while the other shank rests on a stop 30. The arrangement of the rocker arm is such that detent spring 28 tends to open the valve, as illustrated in FIG. 4. This embodiment (common rocker arm for two valves) may also be conceived with the detent and damping systems described with reference to FIGS. 1–2 and 6–7.

The stem, retainer, guide, and seat of the valve are similar to those of the preceding embodiment, as well as the damping system with damping spring 31, which is retained between a sleeve or threaded ring 16B closing a non-referenced chamber of a support 32 and sliding on the valve extension rod 57 with threaded end, on one hand, and a support nut 33 that is blocked by a counternut 34. Valve stem 11 and extension rod 57 are assembled by means of a coupling sleeve 35 that is retained between two counternuts 36.

Figure 5:
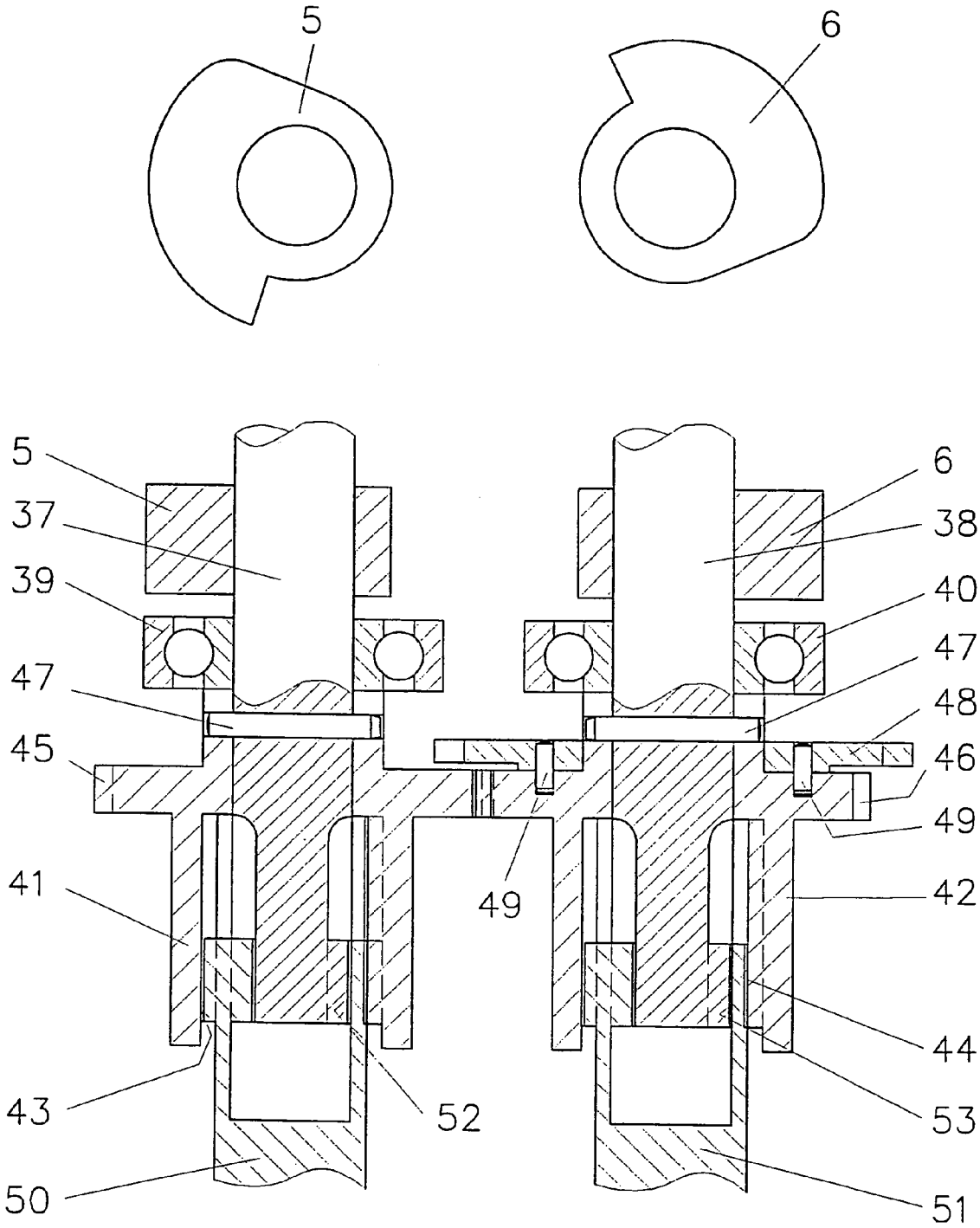
FIG. 5 shows an angular offset control for the cams of FIGS. 1 to 4, FIGS. 5*a* and 5*b* are front views of the opening and closing cams in FIG. 5.

FIG. 5 shows a device for offsetting the angular position of the camshafts relative to the crankshaft, the device being known per se. Opening cam 5 and closing cam 6 are shown in cross-section in FIG. 5 and in front view in FIGS. 5*a* and 5*b*, respectively, the cams being the same as those described above. Cam 5 is fastened on opening camshaft 37 and cam 6 on closing camshaft 38, the camshafts being guided by respective bearings 39, 40. Sleeves 41, 42, provided with helicoidal internal grooves 43, 44 and comprising driving gears 45, 46 of the camshafts are fastened by dowel pins 47 of the gears on the shaft. Camshaft 38 is provided with a toothed pinion 48 that is chain driven by the crankshaft, the pinion being connected to driving gears 46 by fastening means 49.

Control pieces 50 and 51 are fitted on a distance over the ends of the camshafts. The ends comprise an internal coupling by straight spline 52, 53 and an external coupling by helicoidal grooves 43, 44.

In order to effect the mutual angular offset of cams 5, 6, one or the other of the control pieces (50, 51), or both, are slidingly displaced to obtain a shorter or longer valve opening duration.

This control device is also applicable in other timing gear systems, e.g. with finger control or with direct actuation.

Figure 6:
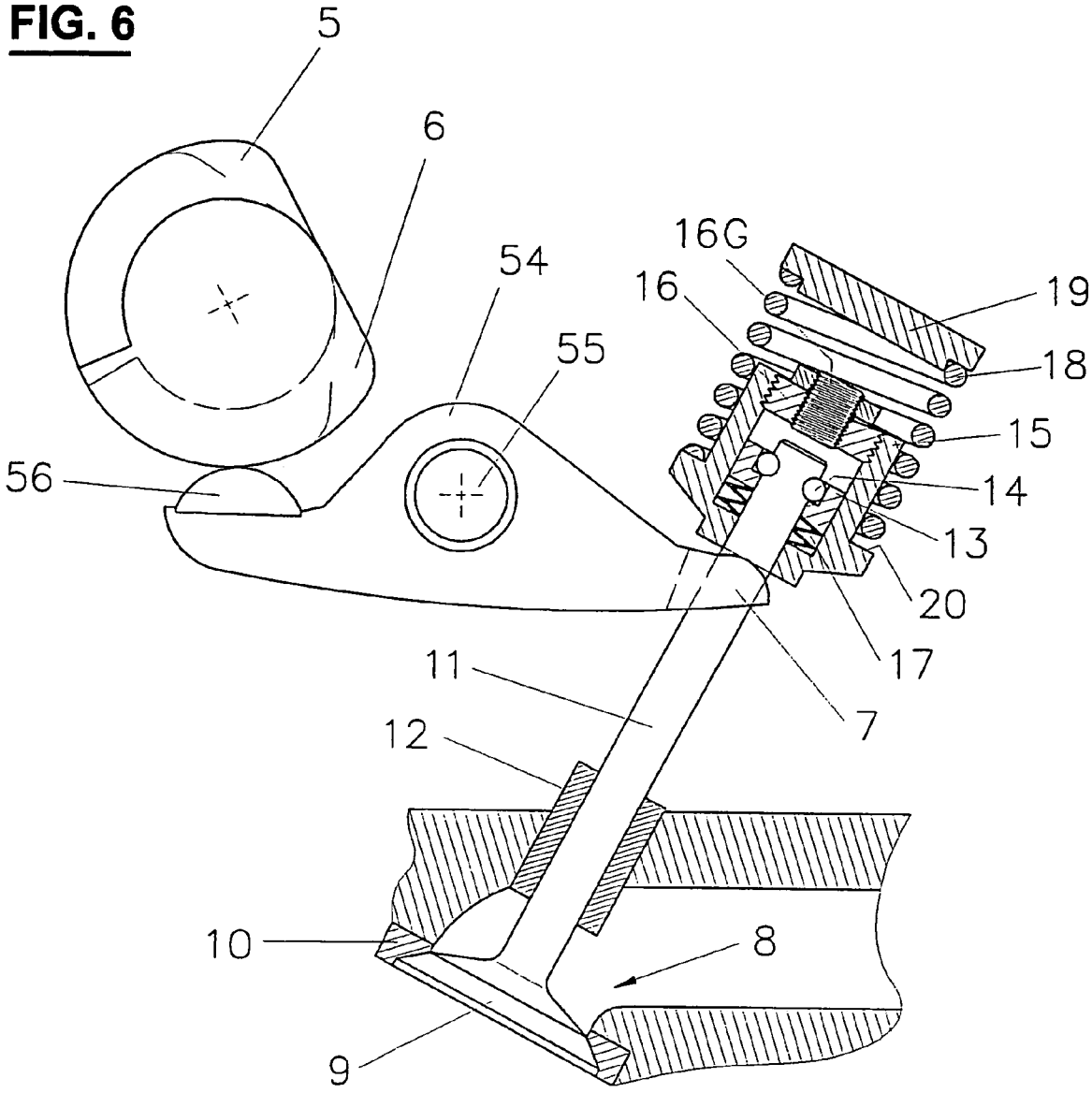
FIG. 6 shows a third embodiment of a device of the invention with the valve in the closed position.
Figure 7:
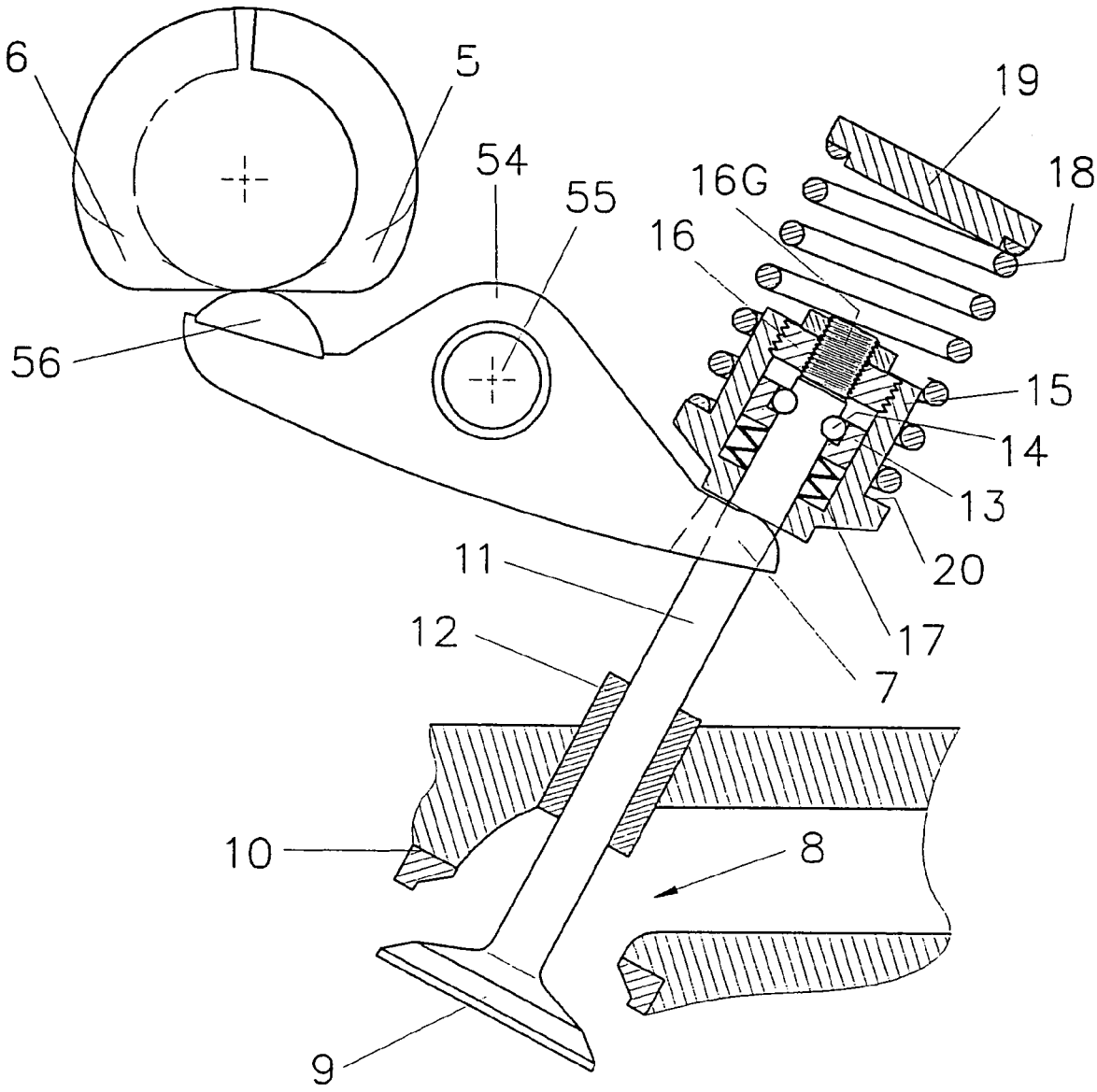
FIG. 7 shows the device of FIG. 6 with the valve in the open position, FIG. 8 schematically shows the operation of the device and the superposed adjustment of the cams for a short opening, and FIG. 9 schematically shows the superposed adjustment of the cams of FIG. 8 for a long opening.
Figure 8:
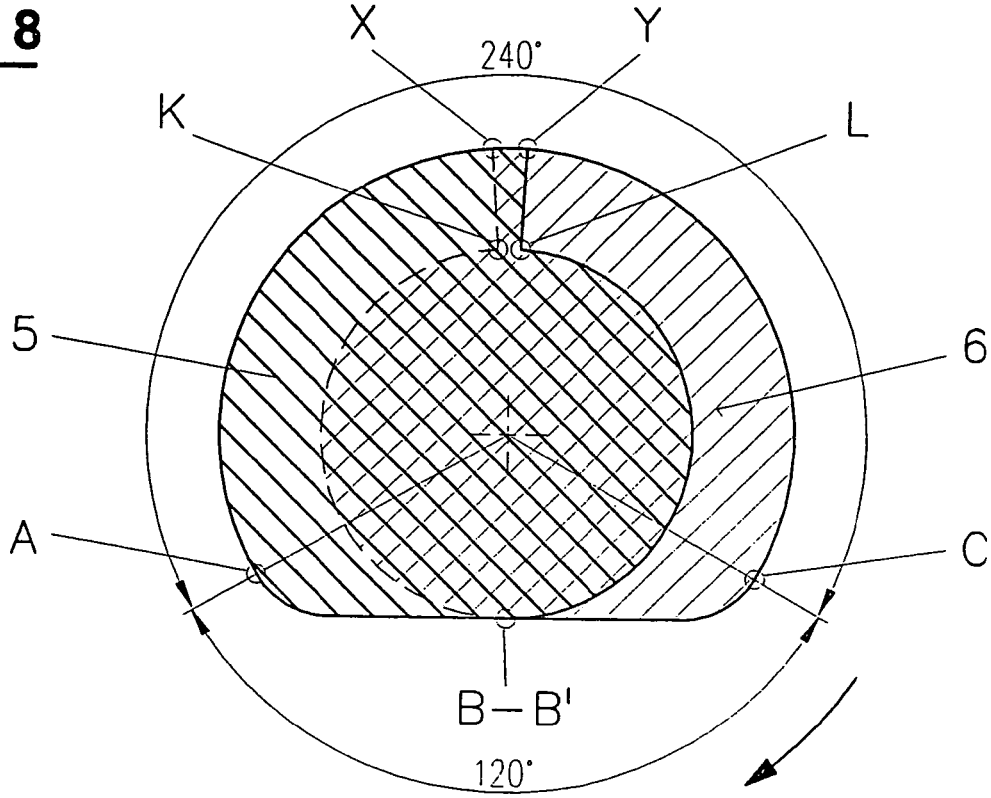
Figure 9:
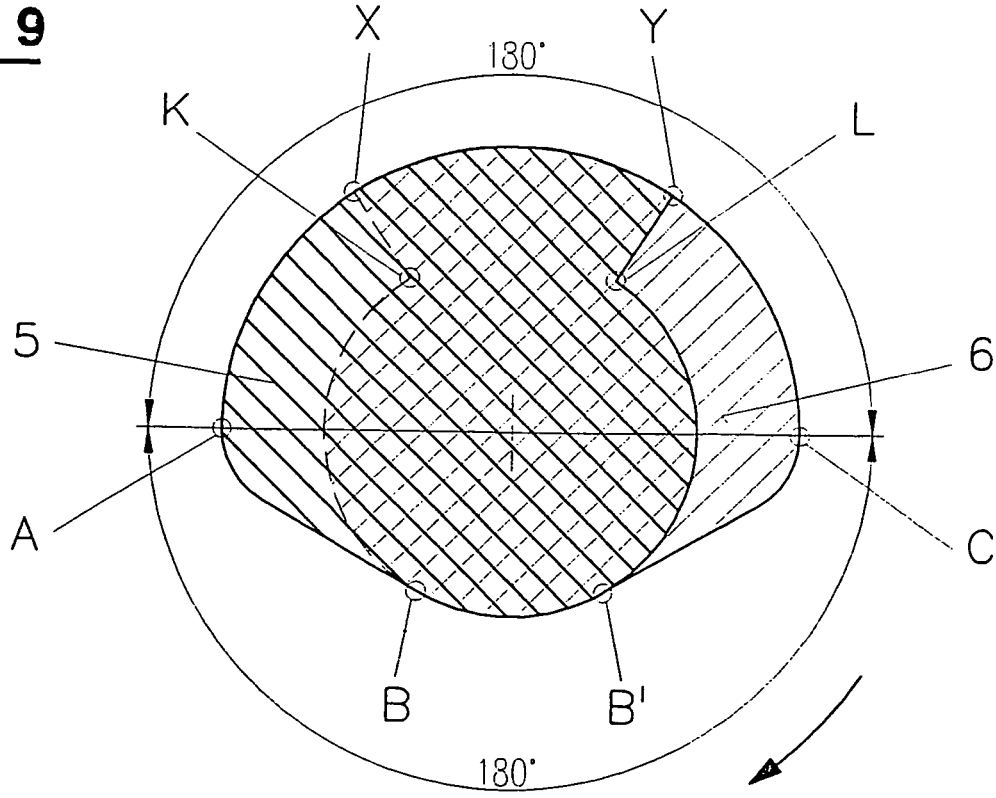

FIGS. 6 and 7 show an embodiment for a cylinder head with two or four valves where cams 5 and 6 are arranged on a single camshaft (see also FIGS. 8 and 9). Valve 8 and its attachment as well as the elastic detent and damping members correspond to those of FIGS. 1 and 2.

Rocker arm 54, oscillating around its shaft 55, is similar to the one illustrated in FIGS. 3 and 4 and comprises two sliders 56 of which only one is visible in the drawing, but it is understood that the control of the angular offset will have to be adapted correspondingly.

FIGS. 8 and 9 schematically show the operation and the adjustment of the superimposed combination of the opening cam and the closing cam, the cams being adjusted to result in a short opening of the valve. The positions of the cams for a desired opening duration of the valve are illustrated, where A is the starting point of the opening, B', B are the points between which the valve is maximally open, and C is the closure end point.

According to the example illustrated in FIG. 8, the valve is closed on 240° and open on 120°. The arc X-Y represents minimum crossing of the cams when the latter are adjusted to the position of short opening of the valve.

In FIG. 9, the opening cam is angularly offset by 30° in its rotating direction and the closing cam is angularly offset by 30° in the opposite direction of its rotation. By these angular offsets, the opening time of the valve is shifted to 180° (respective angles being expressed in degrees of cam rotation).

It follows that in a general manner, and conversely to the traditional devices of the prior art, the elastic detent means 18, 28 acts upon the pair [lever device (1; 21; 54)–valve stem (11)] in the opening direction of the valve (8), whereas the pair [rocker arm device–opening cam 5/closing cam 6] fulfills a double function, namely to allow the opening of the valve and to move it back to its seat 10 for its closure. Based on this original conception as described above, the operating mode may be demonstrated as follows (see particularly FIGS. 1–2 and 8–9):

1. The end of the phase in which valve 8 is closed is ensured by the cam surface corresponding to the profile A-Y of opening cam 5.
2. The opening phase starts when slider 2 has passed point A of cam 5.
3. Valve detent spring 18 expands and enables slider 2 to follow the eccentric profile A-B.
4. From the moment when slider 2 passes point A, and over about 8° of rotation of cam 5, the valve remains closed and damping device 17 expands to its initial position (see point 10 below and FIG. 1).
5. From the instant when this initial position is attained, the movement of cam 5 on rocker arm 1 causes the valve to be lifted from its seat 10.
6. When slider 2 arrives at point B of cam 5, slider 3 simultaneously contacts concentric surface K-B' of closing cam 6 which actuates rocker arm 1 during the closing phase. The valve is now maximally open (see FIG. 2).
7. The closing movement of the valve and the compression of detent spring 18 start when slider 3 arrives at point B' of cam 6 and continue until the slider arrives at point C.
8. For a short opening of the valve, e.g. during 210° of crankshaft rotation, slider 3 contacts surface K-B' exactly at point B', and as points B and B' coincide, the valve immediately starts to close again.
9. For a longer opening up to 350° of crankshaft rotation, three solutions are possible:
   A) either an angular offset of the closing camshaft contrary to the rotational direction, thereby retarding B'-C and thus the closing movement by increasing the distance between B' and B by means of the angular offsetting device.
   B) or an angular offset of the opening camshaft in the rotational direction, thereby advancing A-B and thus the opening movement by increasing the distance between B and B' by means of the angular offsetting device of the opening camshaft.
   C) or the simultaneous application of the two possibilities.
   In all three cases, the valve remains maximally open during the time in which slider 3 moves from B to B'.
10. The valve contacts its seat 10 about 8° before slider 3 reaches point C. Damping device 17 is compressed—retainer 15 sliding valve spring seat 13 on stem 11- and compensates the rest of the lifting movement imparted by cam 6 during the entire duration of the valve closure.
11. The valve closure phase is divided into two stages. In a first stage, the valve is kept closed and detent spring 18 compressed by the action of surface C-X of cam 6 on slider 3.

12. During this action, slider 3 is in waiting position for the flush passage of point Y of cam 5, which marks the second stage.

13. From then on, rocker arm 1 is taken over by surface A-Y of cam at least 5° of cam rotation before slider 3 arrives at X (in order to ensure a minimum cam crossing XY in the case of a short valve opening).

14. Thus, the transition from one cam to the other is free of shocks, and the cycle may start again.

The fact that the drives of the opening and of the closing camshafts are provided with an angular offsetting device with helicoidal grooves, on one hand, and that the profiles of the cams are in agreement, on the other hand, allows to vary the opening and the closing time of the valve independently of each other. Furthermore, the damping device ensures tightness between the seat and the valve without shocks in the timing gear and compensates for the lengthening of the valve due to thermal dilatation.

The cams can be mounted on their shafts in different ways and may be rotationally driven in the same direction. It is also possible to provide a respective shaft for each cam or a common shaft or common shafts.

Thanks to the original cam profiles, it is possible to obtain short (FIG. 8) or long opening durations (FIG. 9) or any other opening/closing durations between the extremes. Thus, in practice, the device operates as a "variable cam", figuratively speaking.

The invention claimed is:

1. A device for controlling the kinematics of at least one valve, the device comprising:

at least one opening cam and one closing cam, at least one rocker device cooperating with said valve;

an elastic member; and an angular offsetting device, wherein:

said elastic member constitutes a detent means which acts in the opening direction of the valve upon an assembly comprised of the rocker device and a valve stem;

the opening cam and the closing cam each comprise a cam portion for retaining the valve against its seat;

said rocker device and said opening cam cooperate to release the valve from its closed position thereby allowing it to be moved to its open position by the elastic member;

said rocker device and said closing cam cooperate to generate the return movement of said valve onto its seat for its closure; and said angular offsetting device is arranged to effect a mutual angular offset of the cams in order to obtain a shorter or longer valve opening duration.

2. The device of claim 1, wherein said opening cam comprises a first concentric portion corresponding to a radius R2 of the cam, a second eccentric portion, and a third concentric portion corresponding to a radius R1 of the cam, R2 being larger than R1, and wherein said closing cam analogously comprises a first concentric portion corresponding to a radius R3 of the cam, a second eccentric portion, and a third concentric portion corresponding to a radius R4 of the cam, R4 being larger than R3.

3. The device of claim 1, wherein said detent means is a spring acting upon said valve stem.

4. The device of claim 3, wherein said stem is attached to said valve by a damping means.

5. The device of claim 4, wherein said damping means is a spring accommodated in a valve retainer mounted on said stem of said valve.

6. The device of claim 5, wherein the chamber of said valve retainer is closed by a nut comprising an adjusting pin for adjusting the initial tension of said damping spring.

7. The device of claim 4, wherein said damping means comprises a damping spring accommodated between two supports, one of which is slidable on an extension rod of the valve.

8. The device of claim 1, wherein said detent means is a detent spring winding around an axle and acting upon an arm of said rocker device.

9. The device of claim 1, comprising a respective camshaft for each cam, wherein the rocker device comprising two slider support arms actuated by said cams and a fork acting upon said valve stem.

10. The device of claim 1, comprising a respective camshaft for each cam, wherein the rocker device comprises an arm bearing a slider and a fork arm acting upon said stem of said valve, said fork further comprising a roller bearing, and said cams acting upon said slider and said roller bearing.

11. The device of claim 1, comprising a respective camshaft for each cam, wherein an angular offsetting device comprises a control piece for each camshaft, said control piece, sliding on the camshaft, being provided with a straight spline coupling and with a coupling by means of helicoidal grooves.

12. The device of claim 11, wherein said offsetting control further comprises driving gears for the camshafts that are actuated by a toothed pinion driven by a chain from the crankshaft.

13. The device of claim 1, comprising opening and closing cams fastened on the same camshaft, wherein the rocker device comprises two sliders actuated by said cams, the rocker arm further comprising a fork acting upon said valve stem.

* * * * *